United States Patent [19]

Withers, Jr. et al.

[11] 4,385,455

[45] May 31, 1983

[54] ROTARY CYLINDER END WALL INSULATOR WITH SEAL

[75] Inventors: L. Andrew Withers, Jr., 5801 Whispering Pines, Mableton, Ga. 30059; Leland A. Withers, Sr., 1706 Greenbrook Dr., Austell, Ga. 30001; Jean D. Withers, Auburn; Carlo Fineo, Austell, both of Ga.

[73] Assignees: Leland A. Withers, Sr.; L. Andrew Withers, Jr., both of Austell, Ga.

[21] Appl. No.: 317,911

[22] Filed: Nov. 3, 1981

Related U.S. Application Data

[63] Continuation-in-part of Ser. No. 258,324, Apr. 28, 1981, and a continuation-in-part of Ser. No. 307,735, Oct. 2, 1981.

[51] Int. Cl.[3] ..... F26B 25/20

[52] U.S. Cl. ..... 34/110; 34/124; 165/89

[58] Field of Search ..... 34/110, 119, 124; 29/110, 118, 119; 100/93 RP; 162/375, 207, 378, 379; 165/89, 146, 185; 219/10.49 A, 469; 432/10, 60, 253, 255.1

[56] References Cited

U.S. PATENT DOCUMENTS

| | | | |
|---|---|---|---|
| Re. 25,927 | 12/1965 | Justus et al. . | |
| 1,076,330 | 10/1913 | Thompson . | |
| 1,640,855 | 8/1927 | Shlick . | |
| 2,047,372 | 7/1936 | Jalens . | |
| 2,074,455 | 3/1937 | Carleton . | |
| 2,413,567 | 12/1946 | Hornbostel . | |
| 2,571,426 | 10/1951 | Doniak . | |
| 2,591,307 | 4/1952 | Sibel . | |
| 4,241,518 | 12/1980 | Alexy . | |
| 4,321,759 | 3/1982 | Gamble | 165/89 |

*Primary Examiner*—Larry I. Schwartz
*Attorney, Agent, or Firm*—Thomas & Kennedy

[57] ABSTRACT

A lightweight pliable heat and noise insulator blanket is mounted to the exterior surface of the axial end wall of a temperature controlled cylinder. The insulator blanket comprises multiple layers of heat and noise insulation material, and the blanket defines a central opening and a slot extending from the central opening through the outer peripheral edge portion so that the blanket can be positioned about the axle of the rotary cylinder. The insulator blanket includes an annular protrusion just inwardly of its outer periphery for placement against the exterior surface of the axial end wall of the rotary cylinder to form a seal between the insulator blanket and the rotary cylinder. The outer peripheral portion of the insulator blanket extends about the connector screws of the rotary cylinder while the annular seal of the insulator blanket is urged by centrifugal force toward a sealed relationship between the insulator blanket and the axial end wall of the rotary cylinder.

16 Claims, 14 Drawing Figures

ROTARY CYLINDER END WALL INSULATOR WITH SEAL

CROSS REFERENCE TO RELATED APPLICATION

This is a continuation-in-part of U.S. patent application Ser. No. 258,324, filed Apr. 28, 1981 and of U.S. patent application Ser. No. 307,735 filed Oct. 2, 1981.

BACKGROUND OF THE INVENTION

This invention relates to thermal and noise insulation of the axial end walls of heated or cooled temperature controlled rotary cylinders, as for example the type of rotatable cylinders used in the paper manufacturing industry, and more particularly to the insulator blanket and the mounting of the insulator blanket to the cylinder end wall.

In the process of manufacturing paper products, wet paper is moved in a web about a plurality of heated rotary cylinders, and the heated cylinders progressively dry the paper. The rotary dryer cylinders can be heated from various heat sources, with a common heat source being superheated steam at a temperature sufficient to heat the cylindrical convex surface of the dryer cylinder to the desired temperature, usually between 100° F. and 600° F. The steam is transmitted under pressure through the axles of the dryer cylinders to heat the inside of the dryer cylinders.

Since the web of paper makes continuing contact with the external convex surface of the dryer cylinder wall during the operation of the dryer cylinder, a major portion of the heat applied to the cylindrical wall of each dryer cylinder is absorbed by and taken away by the paper; however, the web of paper does not contact the axial end walls of the dryer cylinders and most of the heat from inside each dryer cylinder that is transferred through its axial end walls is lost to the atmosphere.

Some attempts have been made to insulate the axial end walls of heated dryer cylinders. For example, the prior art discloses clamping a pair of semi-circular solid insulator panels to the connector screws of the axial end walls of a dryer cylinder. Supporting a solid insulator panel in two halves at the end of a rotatable dryer cylinder is believed to be somewhat hazardous since the halves may tend to part under the stress of centrifugal force and fly off of the rotary cylinder.

While the placement of an insulator panel adjacent the axial end wall of a rotary cylinder tends to reduce the rate of radiant heat transfer from the axial end wall, it is also desirable to retard the transfer of heat due to convection heat transfer. During the rotation of a rotary dryer cylinder, the rotation of the cylinder tends to induce a flow of air radially outwardly of the rotating axial end walls, and the constant flow of air across the axial end wall results in a substantial heat loss from the axial end wall of the rotary cylinder. Also, the turbulent air currents normally present in a paper mill tend to increase convection heat transfer at the axial end walls of a rotating dryer cylinder.

SUMMARY OF THE INVENTION

Briefly described, the present invention comprises a lightweight, pliable end panel heat and noise insulator assembly for a paper machine dryer cylinder, or for similar heated or cooled temperature controlled rotary cylinders, which include an annular, one piece flexible insulation blanket that defines a central opening and an approximately circular outer periphery and a split extending from the inner opening through the outer periphery, whereby the one piece insulator blanket assembly can be positioned about the axle of a rotatable dryer cylinder and mounted in abutment with the axial end wall of the dryer cylinder when the dryer cylinder is in its plant operating configuration. The insulator blanket includes an annular protrusion located inwardly of the peripheral portion of the insulator blanket for application against the exterior surface of the axial end wall of the rotary cylinder to form a seal between the insulator blanket and the axial end wall of the rotary cylinder.

In one embodiment of the invention an annular outer mounting ring of L-shaped cross-section is mounted to the axial end wall of the rotary cylinder with a face span extending about the connector screw heads of the axial end wall of the rotary cylinder and with a cylindrical span extending from the inner surface of the face span at a position radially inwardly of the connector screw heads of the rotary cylinder, and the insulator blanket is mounted to the mounting ring. In other embodiments, a plurality of mounting blocks are mounted to the axial end wall of the rotary cylinder, about the connector screw heads or between the connector screw heads, and the insulator blanket, either with or without a mounting ring, is supported by the mounting blocks.

Thus, it is an object of this invention to provide a flexible, lightweight, durable end panel insulator assembly for mounting to the exterior surface of the axial end wall of a temperature controlled rotary cylinder, such as to a heated dryer cylinder for a paper making process, which reduces the transfer of heat through the axial end wall by radiation and convection heat transfer.

Another object of this invention is to provide an insulator blanket assembly and means for expediently applying the insulator blanket assembly to the axial end wall of the rotary cylinder in its plant operating configuration without modifying or changing the positions of the connector screws extending from the axial end wall to the cylindrical wall of the rotary dryer cylinder.

Other objects, features and advantages of the present invention will become apparent upon reading the following specification when taken in conjunction with the accompanying drawing.

DETAILED DESCRIPTION

Figure 1:
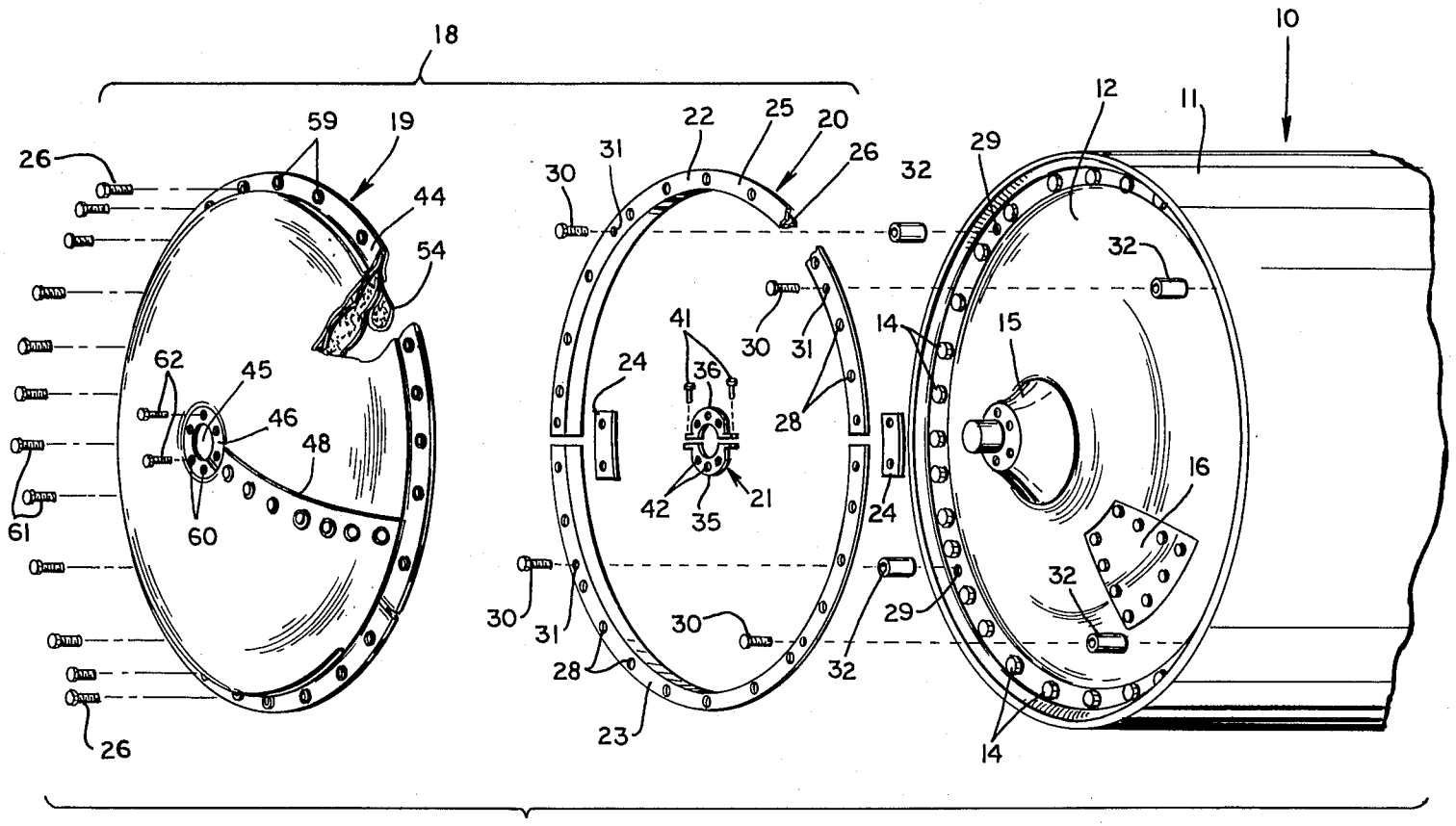
FIG. 1 is a perspective illustration of an end portion of a rotary dryer cylinder of the type used in the paper making industry, showing in an exploded view the insulator blanket assembly, including the mounting ring and insulator blanket, with sections removed from the insulator blanket and from the mounting ring.

Referring now in more detail to the drawings, in which like numerals indicate like parts throughout the several views, FIG. 1 illustrates an end portion of a rotary dryer cylinder 10 of the type used in a paper making process which includes a cylindrical wall 11 and axial walls such as axial end wall 12. The end wall 12 is attached to the cylindrical wall 11 by a plurality of connector screws 14 in an annular array adjacent the periphery of the rotary dryer cylinder, and an axle or journal 15 is formed centrally of the axial end wall 12. An access opening is formed through the axial end wall 12 and cover plate 16 is bolted over the opening.

Figure 2:
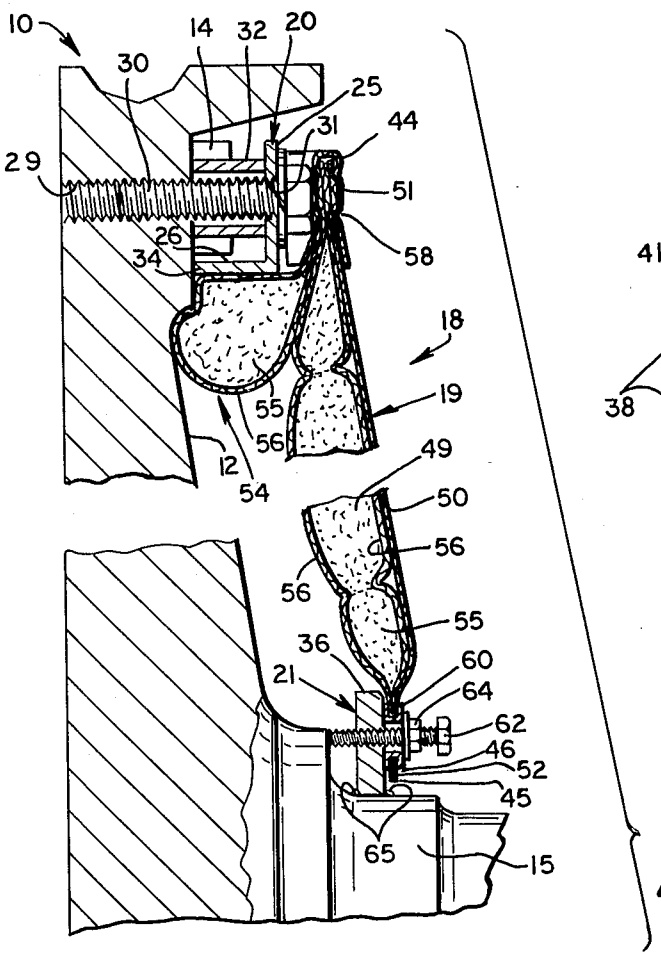
FIG. 2 is a side elevational view of the upper portion of an insulator blanket assembly of FIG. 1, with parts broken away.

The insulator assembly 18 includes a one piece flexible insulator blanket 19, an annular outer mounting ring assembly 20 and an annular inner mounting ring assembly 21. The mounting rings 20 and 21 both are formed in two half sections, with outer mounting ring 20 formed in half sections 22 and 23 and bolted together with connector blocks 24. Outer mounting ring 20 is L-shaped in cross-section and includes face span 25 which is arranged parallel to the axial end wall of the rotary dryer cylinder and cylindrical span 26 which extends from the inner edge of the face span inwardly toward the axial end wall of the rotary dryer cylinder (FIG. 2). A plurality of internally threaded openings 28 are formed through face span 25 for receiving screws 26 that mount the insulator blanket 19 to the mounting ring 20.

As illustrated in FIG. 2, the rotary dryer cylinder 10 includes a plurality of jack screw openings 29 that are located in an annular array about the axial end wall 12 between the connector screws 14. Ring mounting screws 30 extend through mount openings 31 formed in the face span 25 of outer mounting ring 20, and through standoff sleeves 32 that are located between face span 25 of the mounting ring 20 and the axial end wall 12 of the rotary cylinder. The standoff sleeves 32 are of a length which corresponds to the length of the cylindrical span 26 of the outer mounting ring 20, so that the inner annular edge 34 of cylindrical span 26 is maintained in close abutment with the external surface of the axial end wall 12 when ring mounting screws 30 are tightened in the position illustrated in FIG. 2.

Figure 3:
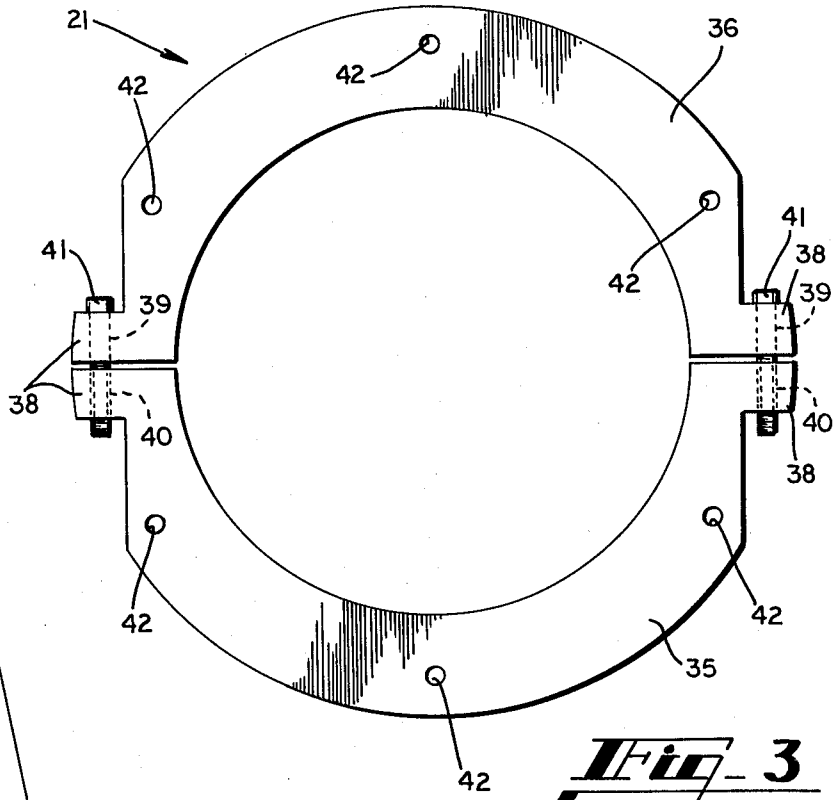
FIG. 3 is an end view of the inner mounting ring of the insulator blanket assembly.

Inner mounting ring 21 is formed in half sections 35 and 36 (FIGS. 1, 2 and 3), and each half section includes protrusions 38 at opposite ends thereof that align with the protrusions of the other half section, and each protrusion includes a through bore. The bores 39 of the protrusion 38 of one half section 36 are not threaded while the bores 40 of the other half section 35 are internally threaded, and screws 41 are projected through the unthreaded bores 39 and through the threaded bores 40 to hold the half sections together. The half sections also include threaded openings 42 spaced thereabout to which the insulator blanket 19 as to be connected.

As illustrated in FIG. 1, the insulator blanket 19 is annular shaped with an outer circular peripheral portion 44, a central opening 45 bordered by an annular inner peripheral portion 46, and a slot or slit 48 extending from inner opening 45 through outer peripheral portion 44. As illustrated in FIG. 2, the insulator blanket 19 comprises multiple layers of material, which includes a quilted body 49, an external cover 50, outer binding 51, inner binding 52, and annular protrusion 54. Quilted body 49 and annular protrusion 54 comprise an inner filler 55 of high temperature resistant material such as Q-9 Nomex quilted mats, nonwoven needle punched Aramid, rockwool, fiber glass or other heat resistant sheet material, and layers of high temperature resistant sheet material 56 such as Kevlar or Viton enclose the inner filler 55. The external cover 50 can comprise, for example, Hypalon or woven sheet material coated with Neoprene, or sheet silicon. The inner and outer peripheral edge portions of the insulator blanket 19 are pressed together and the peripheral bindings 51 and 52 which extend about the peripheral portions and are stitched thereto by lines of stitching such as stitching 58. The sheet material 56 of the annular protrusion 54 has its edges inserted within the outer binding 51 so that the stitching 58 holds the annular protrusion in place just inwardly of the outer peripheral portion of the insulator blanket. The inner and outer bindings can comprise, for example, high temperature resistant durable material such as Viton, or S/470 Nomex Aramid duck sheet material.

A plurality of openings are formed by grommets 59 in the outer peripheral portion of the insulator blanket, while a similar plurality of openings are formed by grommets 60 through the inner peripheral portion of the insulator blanket. The grommets 59 and 60 are spaced apart so as to align with the threaded openings 28 of the outer mounting ring 20 and with the threaded openings 42 of the inner mounting ring 21, and screws 61 project through the grommets 59 and are threaded into the threaded openings 28 of outer mounting ring 20, while screws 62 extend through the grommets 60 and are threaded into the threaded openings 42 of the inner mounting ring 21.

When the insulator blanket 19 is applied to the external surface of the axial end wall 12 of a rotary cylinder 10, the annular protrusion 54 is located radially inwardly of outer mounting ring 20. When the rotary cylinder is rotated, centrifugal force tends to urge the protrusion 54 radially outwardly, so that the protrusion tends to heat against outer mounting ring 20 and against the external surface of the axial end wall 12, to form a seal between the insulator blanket 19 and the axial end wall 12 of the dryer cylinder 10.

As illustrated in FIG. 2, one or more of the screws 62 that extend through the grommets 60 can be of extra length and include a lock nut 64, so that the screw can function as a standoff screw and be threaded through inner mounting ring 20 and into abutment with the axial end wall 12 of the dryer cylinder, tending to push the inner mounting ring 21 along the axis of rotation of the rotary cylinder away from the axial end wall. This tends to stretch the external cover 50 of the insulator blanket 19, to hold the cover in a smooth, somewhat conical configuration, so that the cover does not tend to flap as the dryer cylinder is rotated. After the inner mounting ring 21 has been properly located on the axle protrusion 15, the half sections 35 and 36 of the inner mounting ring are drawn together in frictional engagement with the protrusion 15 by screws 41, and a wedge of cement material, such as silicon 65 is applied to the axle protrusion to assist in holding the inner mounting ring in place along the length of the axle protrusion.

Figure 4:
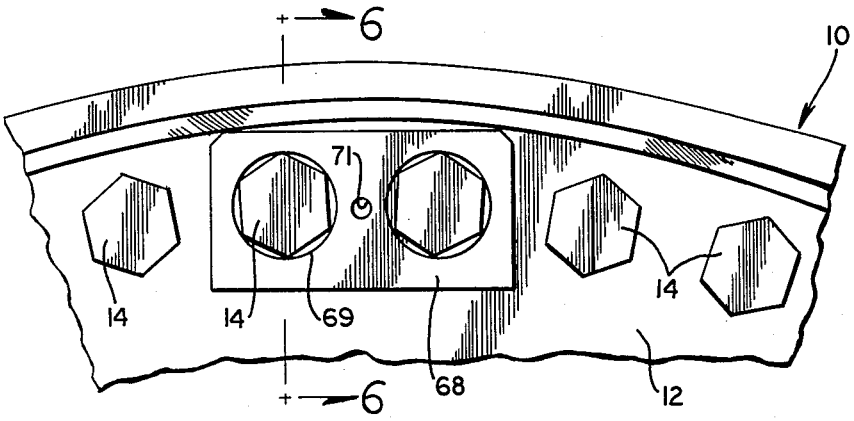
FIG. 4 is a detail illustration of a peripheral portion of the axial end wall of a rotary dryer cylinder, with a rectangular mounting block applied to adjacent ones to the connector screw heads.
Figure 5:
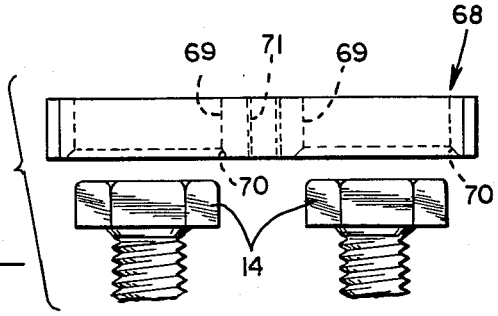
FIG. 5 is a side view of the mounting block of FIG. 4, with the mounting block shown spaced from the connector screw heads to illustrate how the openings of the mounting block fit about the connector screw heads.
Figure 6:
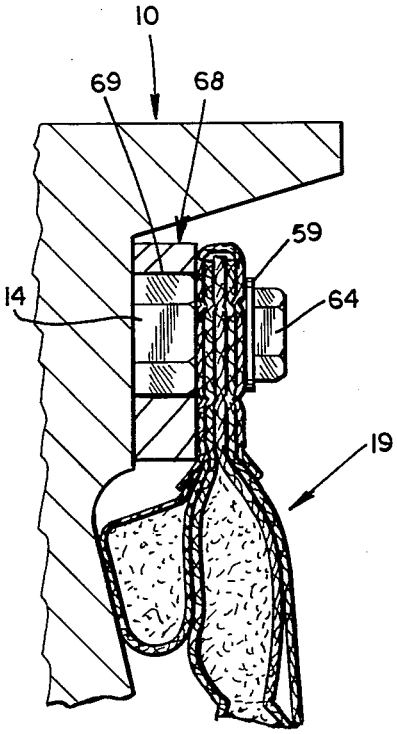
FIG. 6 is a side elevational view of the upper peripheral portion of the rotary dryer cylinder taken along lines 6—6 of FIG. 4, but also including the insulator blanket assembly applied thereto, showing a rectangular mounting block as illustrated in FIGS. 4 and 5, and with the insulator blanket assembly mounted to the mounting block without a mounting ring.

As illustrated in FIGS. 4, 5 and 6, the insulator blanket 19 can be applied at its outer peripheral edge to the rotary dryer cylinder 10 by means of rectangular mounting blocks 68. Each mounting block 68 includes a pair of openings 69 that are sized and spaced to correspond to the size and spacing of the connector screw heads 14 of the rotary dryer cylinder 10. As illustrated in FIG. 5, the openings 69 include a taper 70 at the surface to be applied to the connector screw heads 14 and the mounting block 68 is thrust about the connector screw heads 14, and the screw heads tend to slightly deform the inner surfaces of the openings 69. With this structure and procedure for mounting the rectangular mounting blocks 68, the connector screws 14 are not rotated or otherwise modified in their position on the rotary cylinder, and the mounting blocks 68 tend to hold the connector screws in a non-rotatable position. A central internally threaded opening 71 is formed in each mounting block between the openings 69, and the grommet screws 61 extend through the grommets 59 and into the threaded opening 71 to hold the outer peripheral portion of the insulator blanket to the axial end wall of the rotary cylinder.

Figure 7:
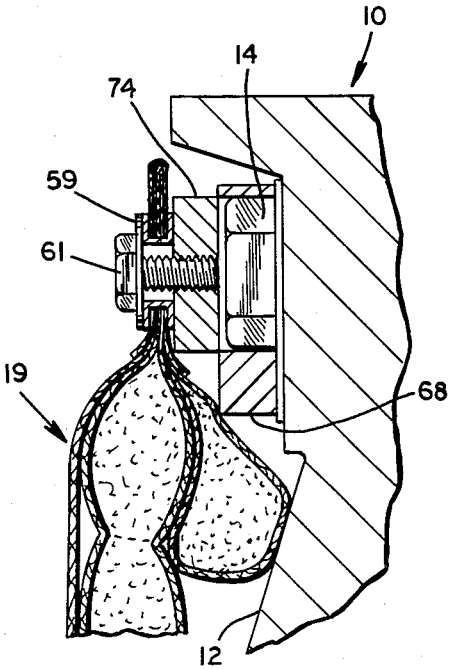
FIG. 7 is a side elevational view, similar to FIG. 6, but showing the insulator blanket assembly mounted to a mounting ring, and the mounting ring mounted to rectangular mounting blocks of the type illustrated in FIGS. 4, 5 and 6.
Figure 8:
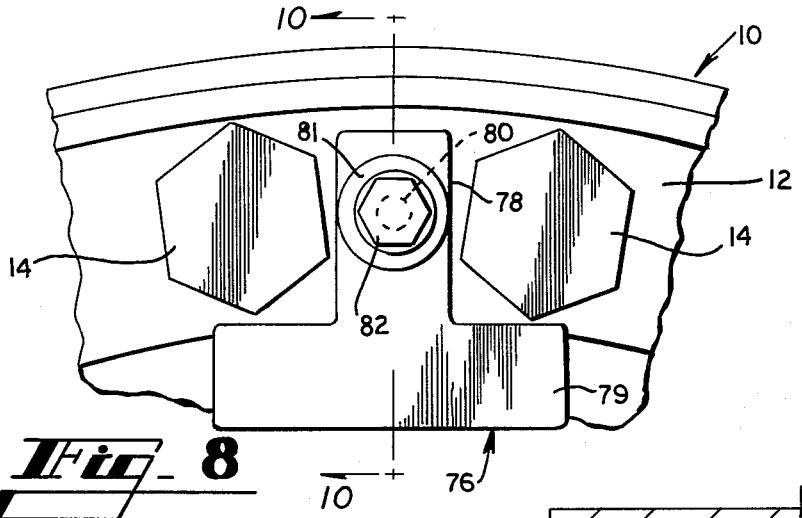
FIG. 8 is a side view of a peripheral portion of the axial end wall of rotary dryer cylinder, showing a T-shaped mounting block with its stem positioned between adjacent ones of the mounting screw heads and its cross bar positioned radially inwardly of the mounting screw heads.
Figure 9:
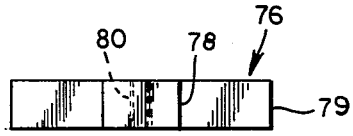
FIG. 9 is an end view of the T-shaped mounting block of FIG. 8, taken along lines 9—9 of FIG. 8.

As is illustrated in FIG. 7, the rectangular mounting block 68 is used in combination with a flat outer mounting ring 74, with the mounting ring 74 being connected to the mounting blocks 68 and with the grommets of the insulator blanket 19 being connected to the outer mounting ring 74.

Figure 10:
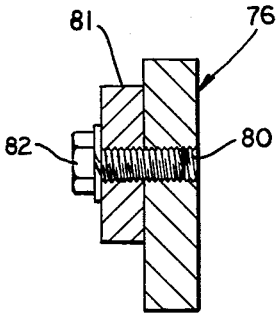
FIG. 10 is a cross-sectional view of the T-shaped mounting block of FIG. 8, taken along lines 10—10 of FIG. 8 and showing an annular mounting ring held to the T-shaped mounting block.
Figure 11:
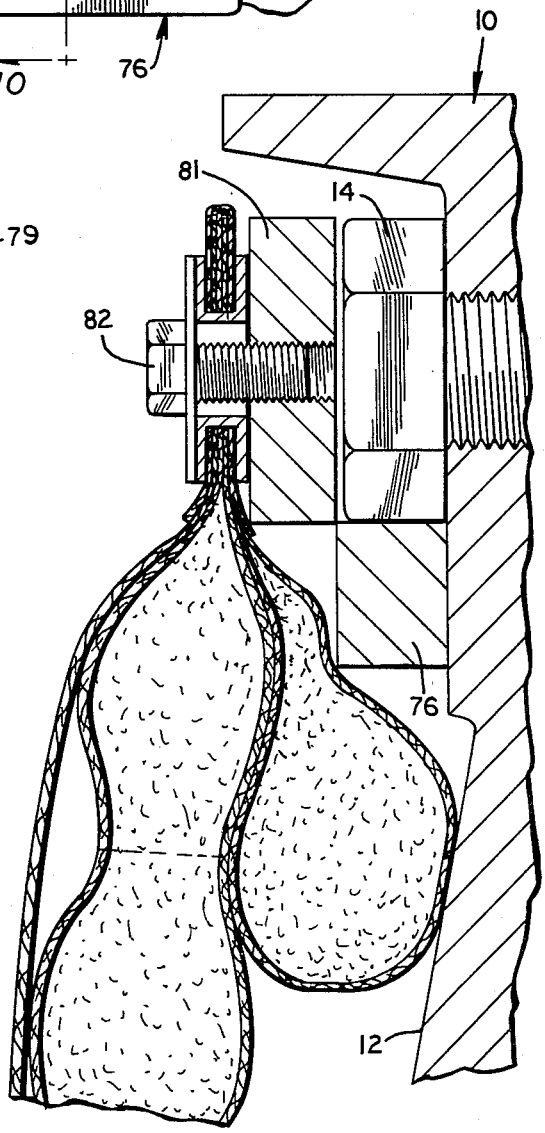
FIG. 11 is a side cross-sectional view of the T-shaped mounting block of FIGS. 8–10, together with the upper peripheral portion of an insulator blanket assembly and a portion of the axial end wall of a rotary cylinder.

As illustrated in FIGS. 8, 9, 10 and 11, T-shaped mounting blocks 76 can be utilized to mount the insulator blanket 19 to the rotary dryer cylinder 10. The T-shaped mounting blocks 76 comprises a stem 78 and a cross bar 79, and the stem is sized and shaped to be inserted between adjacent ones of the connector screw heads 14 while the cross bar 79 is of a length sufficient to extend radially inwardly across adjacent ones of the connector screws 14. The surface of the T-shaped mounting blocks 76 that faces the axial end wall 12 of the rotary dryer cylinder 10 will have an adhesive applied thereto so as to keep the T-shaped mounting block from separating from the axial end wall 12. An internally threaded opening 80 is formed in the stem 78 of the T-shaped mounting blocks 76. As illustrated in FIGS. 10 and 11, a flat mounting ring 81 is mechanically connected to the T-shaped mounting blocks 76 by means of screws 82 extending through openings in the mounting ring 81 are threadedly engaging in the openings 80 of the T-shaped mounting blocks 76. When the rotary dryer cylinder 10 is rotated, the centrifugal forces applied to the T-shaped mounting blocks 76 are transmitted to the connector screw heads 14 which tend to hold the T-shaped mounting blocks in place.

Figure 12:
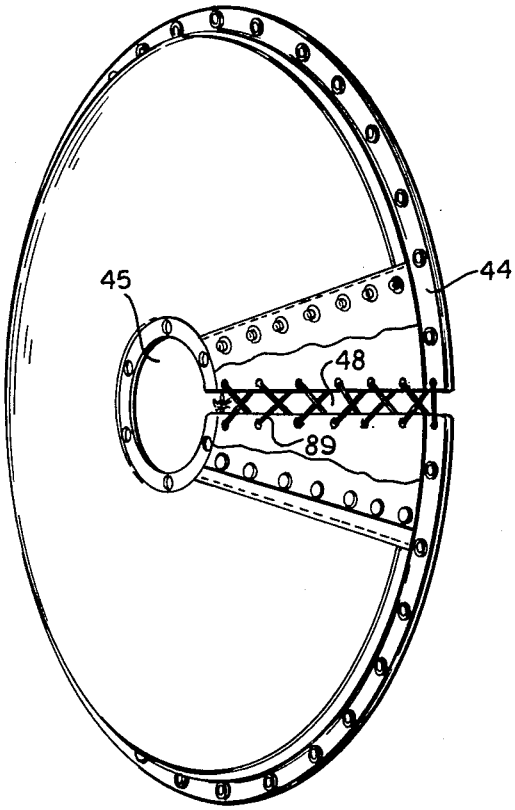
FIG. 12 is a perspective illustration of the insulator blanket assembly, showing the closure flaps for the radial slot removed to expose the slot and its tie strings.
Figure 14:
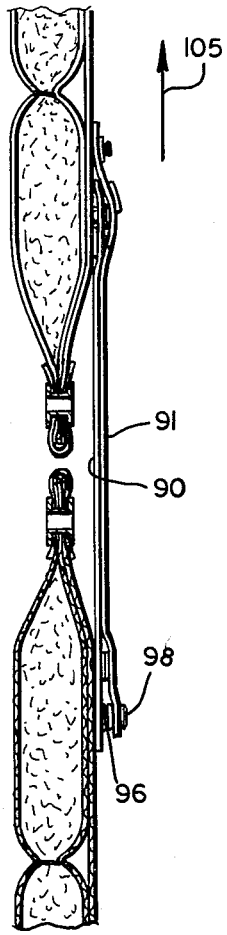
FIG. 14 is a detail edge view of the insulator blanket at the radial slot, showing the closure flaps oriented for clockwise rotation.
Figure 13:
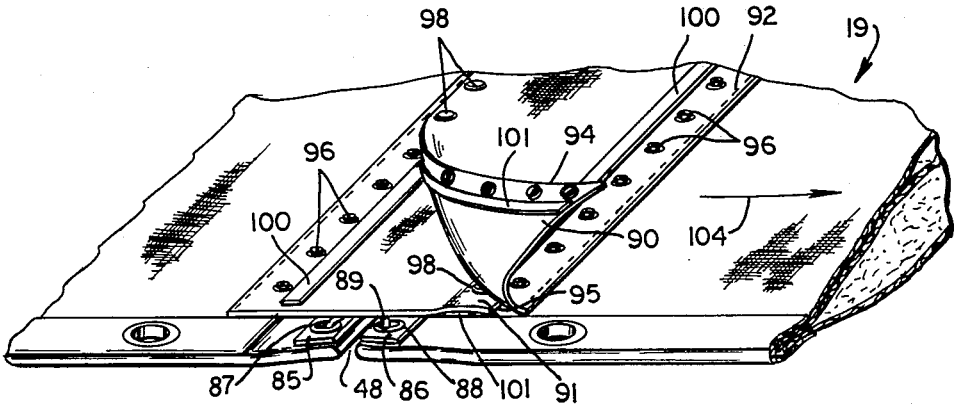
FIG. 13 is detail perspective illustration of the insulator blanket at the outer peripheral edge portion, showing the radial slot and the closure flaps, with the outer closure flap partially pulled away from the inner closure flap, with the flaps oriented so that the insulator blanket rotates in a counter clockwise direction.

As indicated in FIGS. 12, 13 and 14, the radially extending slot 48 extends from the inner opening 45 through the outer peripheral portion 44. The adjacent edges of the slot 48 are bound by tapes 85 and 86, and grommets 87 and 88 extend through the tapes and the material between the tapes. A draw string 89 extends in a criss-cross relationship through the grommets 87 and 88 to draw the edge portions adjacent the slot 48 together.

Closure flaps 90 and 91 are stitched to the insulator blanket with a line of stitching such as stitching 92 on opposite sides of the slot 48, and the free edge portions 94 and 95 extend over the slot 48. The closure flaps 90 and 91 are substantially identical in that each includes a line of male snap elements 96 adjacent its stitched edge and a line of female snap elements 98 adjacent its free edge, with the female snap elements directed inwardly of the flaps and with the male snap elements directed outwardly of the flaps. Velcro strips 100 are attached to the external surfaces of each flap adjacent the line of male snaps 96, and mating Velcro strips 101 are connected to the inner surfaces of the flaps adjacent the female snaps 98.

When the flaps 90 and 91 are to be closed over the slot 48 in a condition where the insulator blanket 19 is to rotate in a counter clockwise direction as indicated by arrow 104, the flap 91 is stretched over slot 48 and the flap 90 is then stretched over the inner flap 91 so that its female snaps 98 connect to the male snaps 96 and its Velcro strip 101 engages and connects to the Velcro strip 100. When the direction of rotation of the insulator blanket is to be in a clockwise direction as indicated by arrow 105 (FIG. 14), the relationship of the flaps is reversed, so that flap 90 is located inside flap 91, and the female snaps 98 of the outer flap 91 engage the male snaps 96 of the inner flap 90, and the Velcro strips 100 and 101 engage each other as illustrated. With this arrangement, the flaps can be oriented so that the relative wind due to the rotation of the insulator blanket, which will be opposite to the arrows 104 and 105, will flow smoothly over the flaps and will not tend to open the flaps.

While this invention has been described in detail with particular references to a preferred embodiment thereof, it will be understood that variations and modifications can be effected within the spirit and scope of the invention as described hereinbefore and as described in the appended claim.

We claim:

1. An insulator assembly for mounting to the exterior surface of the axial end wall of a temperature controlled rotary cylinder, the end wall including a series of connector screw heads protruding therefrom at its periphery in an annular array and an axle protruding centrally therefrom, said end panel insulator assembly including a one piece flexible insulator blanket with an annular outer peripheral edge portion sized to extend adjacent the connector screw heads of the rotary cylinder, a central opening with an annular inner peripheral edge portion sized to extend about the axle of the rotary cylinder, and a slot extending radially from said central opening through said annular outer peripheral edge portion, means for closing said slot, means for mounting the annular outer peripheral portion of said insulator blanket to an end wall of the rotary cylinder, and a soft annular protrusion connected to the insulator blanket adjacent the outer peripheral edge portion of the blanket and extending from the blanket toward the axial end wall of the rotary cylinder for engagement with the axial end wall inside the annular array of connector screw heads of the axial end wall of the rotary cylinder for forming an annular seal between the annular outer peripheral portion of said insulator blanket and the end wall of the rotary cylinder adjacent the annular array of screw heads.

2. The insulator assembly of claim 1 and further including means for mounting the annular inner peripheral portion of said insulator blanket to the portion of the axial end wall adjacent the axle.

3. The insulator assembly of claim 1 and further including an inner mounting ring of a diameter sufficient to extend about the axle of the rotary cylinder for connection to the annular inner peripheral edge portion of said insulator blanket, means for attaching said inner mounting ring to the axial end wall of the rotary cylinder and means for urging the inner mounting ring away from the axial end wall of the rotary cylinder to stretch said insulator blanket.

4. An insulator for mounting to the exterior surface of the axial end wall of a temperature controlled rotary cylinder, the end wall including at its outer peripheral portion a series of connector screw heads arranged in an annular array and an axle protruding centrally therefrom, said insulator comprising a one piece flexible insulator blanket with an annular outer peripheral edge portion sized to extend about the connector screw heads of the rotary cylinder, a central opening with an annular inner peripheral edge portion sized to extend about the axle of the rotary cylinder, a slot in said insulator blanket extending radially from said central opening through said annular outer peripheral edge portion, connector means for mounting the outer peripheral edge portion of said insulator blanket to the axial end wall of the rotary cylinder about the connector screw heads, said insulator blanket including at its outer peripheral portion an annular protrusion for mounting against the axial end wall of the rotary cylinder at a position radially inwardly of the connector screw heads of the end wall of the rotary cylinder whereby the centrifugal forces exerted on the annular protrusion during rotation of the insulator blanket with the rotary cylinder tend to urge the annular protrusion radially outwardly so that the protrusion tends to seat against the external surface of the axial end wall inwardly of the series of connector screw heads and form a seal against the axial end wall of the rotary cylinder.

5. The insulator of claim 4 and wherein said connector means comprises a plurality of approximately T-shaped mounting blocks each including a stem for placement between adjacent ones of the connector screw heads of the rotary cylinder and each including a cross bar for placement in inward abutment with the adjacent connector screw heads of the rotary cylinder, each mounting block including an internally threaded opening for receiving a screw for connecting the insulator blanket to the mounting block, and means for connecting the mounting block to the axial end wall of a rotary cylinder.

6. The insulator of claim 4 and wherein said connector means comprises an annular mounting ring assembly sized to extend about the annular array of connector screw heads, said mounting ring being L-shaped in cross-section with a face span for extending about the connector screw heads and a cylindrical span extending at an approximately right angle with respect to said face span and for extending toward the axial end wall of the rotary cylinder inwardly adjacent the annular array of connector screw heads.

7. The insulator of claim 6 and wherein the axial end wall of the rotary cylinder includes jack screw openings, and wherein said connector means includes screws for extending through openings in the face span of said mounting ring and into the jack screw openings of the rotary cylinder.

8. The insulator of claim 4 and wherein said connector means comprises a plurality of mounting blocks each defining a pair of openings therein sized and positioned to be inserted about adjacent ones of the connector screw heads of the rotary cylinder and each mounting block including an internally threaded opening for receiving a screw for connecting the insulator blanket to the mounting block.

9. An insulator blanket for mounting to the exterior surface of the axial end wall of a temperature controlled rotary cylinder, the end wall including an axle protruding centrally therefrom, said insulator blanket comprising an annular outer peripheral edge portion, a central opening with an annular inner peripheral edge portion seized to extend about the axle of the rotary cylinder, a slot extending radially from the central opening through said outer peripheral edge portion, connector means for holding the edges of said blanket at said slot in juxtaposition, and flap means connected to said blanket at said slot for extending from one edge portion toward the other edge portion of said blanket at said slot to overlap said connector means.

10. The insulator blanket of claim 9 and wherein said connector means comprises a series of grommets formed in said blanket and extending along the edges of said blanket at said slot, and a draw string for extending through said slots for drawing together the edges of said blanket at said slot.

11. The insulator blanket of claim 9 and wherein said flap means comprises two flaps, one flap connected to said insulator blanket on one side of said slot and the other flap connected to said insulator blanket on the other side of said slot, and means for connecting the flaps together in closed relationship about said connector means.

12. An insulator assembly for mounting to the exterior surface of the axial end wall of a temperature controlled rotary cylinder, the end wall including a series of connector screw heads protruding therefrom at its periphery in an annular array and an axle protruding centrally therefrom, said end panel insulator assembly including a one piece flexible insulator blanket with an annular outer peripheral edge portion sized to extend adjacent the connector screw heads of the rotary cylinder, a central opening with an annular inner peripheral edge portion sized to extend about the axle of the rotary cylinder, and a slot extending radially from said central opening through said annular outer peripheral edge portion, means for closing said slot, means for mounting the annular outer peripheral portion of said insulator blanket to an end wall of the rotary cylinder and for forming a seal between the annular outer peripheral portion of said insulator blanket and end wall of the rotary cylinder comprising a mounting ring approximately L-shaped in cross-section and including a face span oriented approximately parallel to the axial end wall of the rotary cylinder and a cylindrical span extending from the inner edge of said face span, connector means for mounting said mounting ring to the axial end wall of the rotary cylinder with the cylindrical span of the mounting ring extending toward the axial end wall of the rotary cylinder at a position within the array of connector screws of the rotary cylinder, said insulator blanket further including an annular protrusion located inwardly of said annular mounting ring and which is biased by centrifugal forces outwardly toward engagement with the axial end wall of the rotary cylinder to form a seal between the annular peripheral portion of said insulator blanket, the end wall of the rotary cylinder, and the cylindrical span of said mounting ring.

13. The insulator assembly of claim 12 and wherein said connector means is constructed and arranged to urge the cylindrical span of said mounting ring into engagement with the end wall of the rotary cylinder.

14. The insulator assembly of claim 12 and wherein the axial end wall of the temperature controlled rotary cylinder includes jack screw openings in an annular array at positions between the connector screw heads, and wherein said connector means for mounting said mounting ring to the axial end wall of the rotary cylinder comprises threaded screws for insertion through openings in the face span of said mounting ring and into the jack screw openings of the rotary cylinder openings.

15. An insulator assembly for mounting to the exterior surface of the axial end wall of a temperature controlled rotary cylinder, the end wall including a series of connector screw heads protruding therefrom, said end panel insulator assembly including a one piece flexible insulator blanket with an annular outer peripheral edge portion sized to extend adjacent the connector screw heads of the rotary cylinder, a central opening with an annular enner peripheral edge portion sized to extend about the axle of the rotary cylinder, and a slot extending radially from said central opening through said annular outer peripheral edge portion, means for closing said slot, means for mounting the annular outer peripheral portion of said insulator blanket to an end wall of the rotary cylinder and for forming a seal between the annular outer peripheral portion of said insulator blanket and end wall of the rotary cylinder including an annular protrusion located inwardly of the annular outer peripheral edge portion of said insulator blanket, and a peripheral binding extending about the annular outer peripheral edge portion of said insulator blanket and anchoring said annular protrusion to said insulator blanket.

16. An insulator for mounting to the exterior surface of the axial end wall of a temperature controlled rotary cylinder, the end wall including at its outer peripheral portion a series of connector screw heads arranged in an annular array and an axle protruding centrally therefrom, said insulator comprising a one-piece flexible insulator blanket with an annular outer peripheral ege portion sized to extend about the connector screw heads of the rotary cylinder, a central opening with an annular inner peripheral edge portion sized to extend about the axle of the rotary cylinder, a slot in said insulator blanket extending radially from said central opening through said annular outer peripheral edge portion, connector means for mounting the outer peripheral edge portion of said insulator blanket to the axial end wall of the rotary cylinder about the connector screw heads, a peripheral binding formed about the annular outer peripheral edge portion of said insulator blanket, said insulator blanket including at its outer peripheral portion an annular protrusion for mounting against the axial end wall of the rotary cylinder inwardly of the series of connector screw heads to form a seal between said insulator blanket and the axial end wall of the rotary cylinder, said annular protrusion being held to said insulator blanket by said peripheral binding.

* * * * *